United States Patent [19]

Breckwoldt

[11] Patent Number: 4,693,266

[45] Date of Patent: Sep. 15, 1987

[54] SMOKING MATERIAL

[75] Inventor: Robert G. Breckwoldt, Goshen, N.Y.

[73] Assignee: Tripar Incorporated, Stamford, Conn.

[21] Appl. No.: 835,351

[22] Filed: Mar. 3, 1986

[51] Int. Cl.[4] ..... A24B 15/00; A24B 15/10; A24D 1/18

[52] U.S. Cl. ..... 131/359

[58] Field of Search ..... 131/359, 369

*Primary Examiner*—V. Millin

*Attorney, Agent, or Firm*—Kane, Dalsimer, Kane, Sullivan and Kurucz

[57] ABSTRACT

A smoking material comprises tobacco homogeneously mixed with a smoke-affecting proportion of distiller's dried grain with solubles. The smoking material of the invention possesses a smoother, flavor-enhanced smoke.

2 Claims, No Drawings

SMOKING MATERIAL

BACKGROUND OF THE INVENTON

1. Field of the Invention

The invention relates to smoking materials and more particularly relates to tobacco smoking products enhanced by the presence of distiller's dried grain and solubles as an extender and flavor enhancer 2. Brief Description of the Prior Art The prior art literature is replete with descriptions of tobacco smoking materials which have included in their make-up a wide variety of extenders, flavorants, smokeaffecting additives and other smokable additives. Representative of such descriptions are those found in the U.S. Pat. Nos. 3,034,931; 3,477,443; 3,796,222; 3,964,494; 3,964,495; 3,964 496; 3,977,412; 3,977,413; 3,977,414; 3,977,415; 4,534,372 and the references cited therein.

SUMMARY OF THE INVENTION

The invention comprises a smoking material which comprises tobacco in admixture with a smoke-enhancing proportion of distiller's dried grain with solubles The smoking material of the invention is an improvement over tobacco per se, yielding a smoother, more flavorful sensation to the smoker. The smoking material of the invention has a reduced nicotine concentration (due to dilution).

DETAILED DESCRIPTION OF THE PREFERRED EMBODIMENTS OF THE INVENTION

Distiller's dried grain with solubles (referred to hereinafter at times as "DDGS") is the product obtained upon drying stillage (sometimes called "slop"), which is the residue after distillation and removal of alcohols from beer or fermentated grain mash. Typically the DDGS is prepared by first separating fiber or suspended solids from the stillage. The residue of soluble solids is then concentrated to the consistency of a paste (called syrup) and then remixed with the separated fiber. The remixed fiber and syrup is then dried to obtain a meal which is the DDGS employed in the present invention.

The DDGS is readily available from commercial sources The composition of DDGS is well known. A typical DDGS composition will comprise crude protein (27 percent by weight), crude fat (8 percent by weight) and crude fiber (8.5 percent by weight); dry matter constituting about 92.5 percent by weight.

The smoking material of the invention is prepared by homogeneously mixing the DDGS with a smokable tobacco form Representative of such tobacco is shredded tobacco leaf, useful in the manufacture of cigarettes and pipe-smoking blends. The smoking material of the invention may also be mixed with reconstituted tobacco. The resultant product of either mixture is preferentially used as cigar or cigarette filler. Reconstituted tobacco may comprise a mixture of tobacco stems, laminas, fines and like tobacco plant components or remnants. Reconstituted tobacco webs or paper and the method of their manufacturer are well known to those skilled in the art; see for example the descriptions given in the U.S. Pat. Nos. 3,297,039 and 4,542,755 (which are incorporated herein by reference thereto). Advantageously the DDGS to be added to the tobacco will be in a paper form, said paper form obtained by blending the DDGS with appropriate binding agents such as bleached cellulose fibers sufficient in quantity to produce a paper product similar in character to reconstitute tobacco.

Mixing of the DDGS with the smokable tobacco may be carried out using conventional blending apparatus, conventionally used to mix tobacco with previously known additives. The proportion of DDGS homogeneously blended with or added to the smokable tobacco to obtain the smoking material of the invention is a smoke-enhancing proportion. In general a smoke-enhancing proportion will be an amount within the range of from about 0.5 to 80 percent by weight of the tobacco ingredient; preferably about 3 to 50 percent; most preferably 5 to 30 percent.

In addition to DDGS and tobacco the smoking materials of the invention may contain conventionally employed proportions of conventionally known tobacco additives such as flavorants (like menthol), binders, humectants (like propylene glycol, sorbitol and the like), extenders or fillers (like hydroxymethylcellulose), flavor enhancers and the like.

The following examples describe the manner and the process of making and using the invention and set forth the best mode contemplated by the invention for carrying out the invention.

EXAMPLE 1

Handsheets of reconstituted tobacco are prepared by first blending together a mixture of tobacco fines, fiberized tobacco stems (particle sizes less than 60 mesh), 15 percent by weight of tobacco components of bleached southern pine softwood pulp and 5 percent by weight of DDGS (flaked, average particle size less than 60 mesh). The blend, having a moisture content of circa 35 percent, is processed into handsheets by the general method described in Example 1 of U.S. Pat. No. 4,542,755. The handsheets are then shredded to obtain a cigarette smoking material of the invention.

EXAMPLE 2

The procedure of Example 1, supra., is repeated utilizing all DDGS and other ingredients and containing no tobacco products whatsoever.

EXAMPLE 3

The shredded hand sheet of Example 2, supra., is mixed with shredded tobacco at a level of 10% of the weight of the tobacco.

EXAMPLE 4

The procedure of Example 1, supra., is repeated except that the DDGS component is not added to the tobacco blend. This example is not an example of the invention but is made for comparative purposes.

The cigarette smoking material of Examples 1 and 3, supra., are smoked by a panel of of ten smokers and judged for smoothness of smoke and flavor. A majority of the smoking panel chose the cigarette smoking material of the invention (Examples 1 and 3) as providing a smoother, more flavorful smoke.

What is claimed is:

1. A smoking material, which comprises; tobacco in admixture with from about 0.5 to 80 percent by weight of the tobacco of distiller's dried gran with solubles.

2. A smoking material of claim 1 wherein the tobacco is reconstituted tobacco.

* * * * *